US005596842A

United States Patent [19]

Sjoholm

[11] Patent Number: 5,596,842

[45] Date of Patent: Jan. 28, 1997

[54] SLIDING ELEMENT SYSTEM

[76] Inventor: Jarmo Sjoholm, Hovitie 20, FIN-01380 Vantaa, Finland

[21] Appl. No.: 416,769

[22] PCT Filed: Oct. 14, 1993

[86] PCT No.: PCT/FI93/00423

§ 371 Date: Apr. 13, 1995

§ 102(e) Date: Apr. 13, 1995

[87] PCT Pub. No.: WO94/09238

PCT Pub. Date: Apr. 28, 1994

[30] Foreign Application Priority Data

Oct. 14, 1992 [FI] Finland ..... 924654

[51] Int. Cl.[6] ..... E05D 15/22

[52] U.S. Cl. ..... 49/177

[58] Field of Search ..... 49/177, 176, 178, 49/179, 180, 149

[56] References Cited

U.S. PATENT DOCUMENTS 3,750,334 8/1973 Slaybaugh ..... 49/177
5,058,321 10/1991 Harbom et al. ..... 49/177

FOREIGN PATENT DOCUMENTS 166811 1/1986 European Pat. Off. .
911469 9/1992 Finland .

*Primary Examiner*—Philip C. Kannan
*Attorney, Agent, or Firm*—Andrus, Sceales, Starke & Sawall

[57] ABSTRACT

A sliding element system, wherein the guide wheel sets (8, 9) of the lower side (3) of the sliding element (1) are designed to support the sliding element (1) on a lower guide section (3). To the lower side (3) is connected a vertical wheel set (8) comprising a vertical wheel (15), the diameter of which is smaller than the transverse inside dimension of the lower guide section, the plane of rotation of which is vertical, the peripheral cross section is round-shaped, and the point of contact with the lower guide section (5) is located on the same vertical line as the central axis of the wheel axle (10). The lower guide section (5) comprises a longitudinal, upward open bottom groove (16) the edges of which serve as rolling surfaces for the vertical wheel (15). The vertical wheel (15) and the bottom groove (16) are mutually fitted so that when the plane of rotation of the vertical wheel parallels the bottom groove, the vertical wheel extends partly into the bottom grove, whereby when the sliding element is being swivelled at a hinging point to stand at an angle relative to the guide sections, the vertical wheel (15) disposed to be fixed in relation to the sliding element, will rise upwardly carried by the edges of the bottom groove (16) and a first coupling member (13) will be coupled by form-locked connection with a second coupling member (14).

13 Claims, 5 Drawing Sheets

Figure 1:
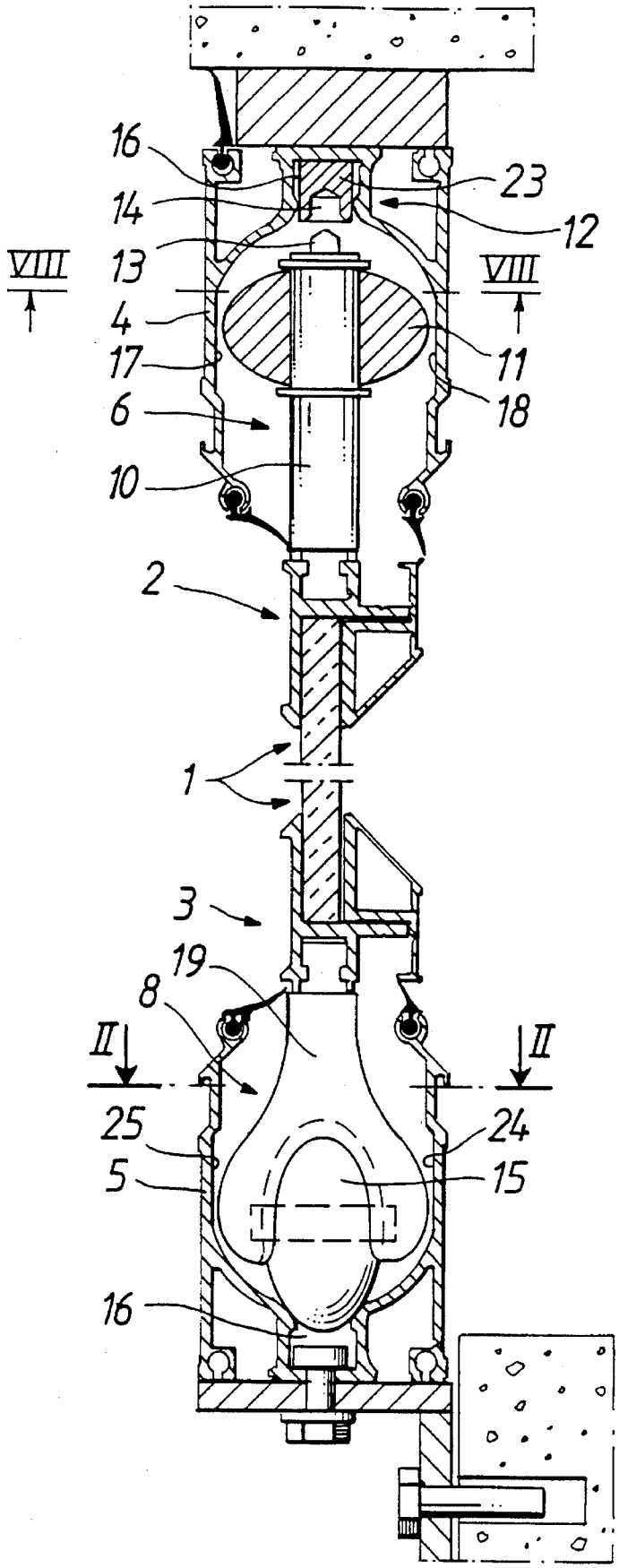

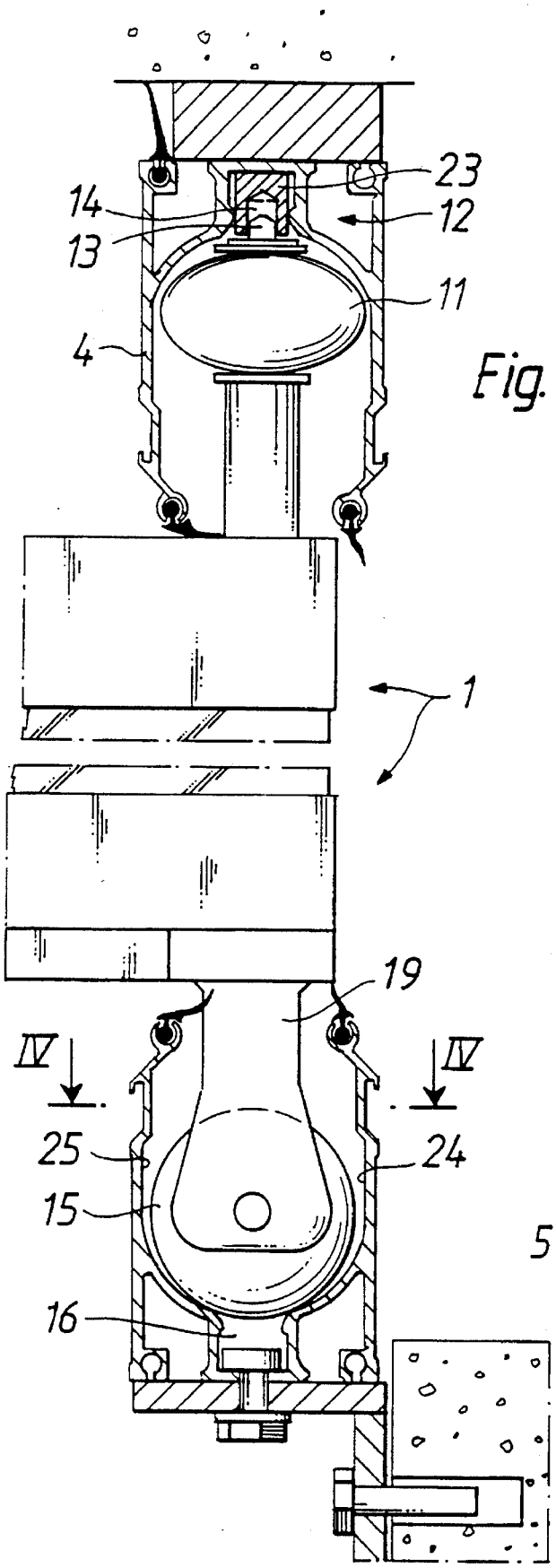
Fig. 3
Fig. 4
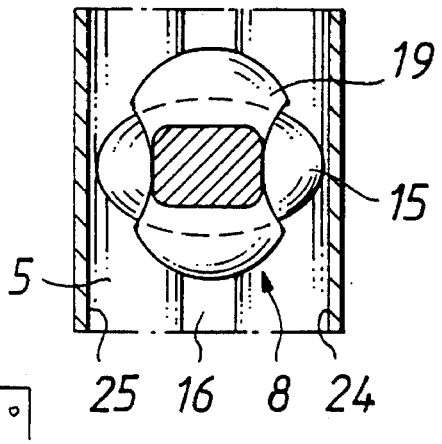

SLIDING ELEMENT SYSTEM

The present invention concerns a system as defined in the preamble to Claim 1.

In prior art a sliding element system is known comprising a substantially vertical sliding element having an upper side and a lower side, parallel in relation to each other. The system further comprises an elongated and box-like upper guide section, located adjacent to the upper side; an elongated and box-like lower guide section, located adjacent to the lower side; and guide wheel sees, connected to the upper side and the lower side of the sliding element and said guide wheel sets comprising at least one horizontal wheel set. Such a horizontal wheel set comprises a vertical wheel axle, affixed to the upper side, and a horizontal wheel, rotatably carried on the wheel axle so that its plane of rotation is horizontal. The guide wheel sets are disposed to run in guidance of the guide sections, inside these. The system further comprises a hinge arrangement comprising, interlocking with each other, a first coupling element, connected to the wheel axle, and a second coupling element, connected to the upper guide section. The wheel axle serves, after the coupling elements have become engaged, as a hinge axle around which the sliding element can be swivelled. A particular application of a sliding element system of this type is a balcony glass pane system in which the sliding elements comprise a glass panel. In a system of prior art, described in the Finnish patent applications FI-914848 and FI-915100, the sliding element is simultaneously supported by the upper as well as lower guide section in such manner that the sliding element cannot move in any direction other than the sliding direction.

The problem in any system of prior art of said type is that the distance between the upper and lower guide sections and their parallellism must be adjusted with great accuracy by trimming both guide sections. When the sliding element system is a balcony glass system, this need of adjusting both sections, the upper and lower section, may also give rise to a labour safety problem. Installation work of balcony glass panes, on balconies, is usually carried out at great height from the ground, and in order to adjust the upper guide section the fitter has to step on a platform, involving obvious risk of toppling over the railing. This risk is particularly accentuated in winter conditions, when the balcony may be covered with snow and ice. A further problem encumbering the system of prior art is that it comprises a comparatively great number of parts.

The object of the invention is to eliminate these drawbacks.

The object of the invention is specifically to disclose a system which is inexpensive and the parts and components of which are simple as to their construction, and in which fewer components than before are required.

It is further an object of the invention to disclose a system wherein no accurate adjustments of the upper guide section need be done: all the essential adjustments of the system can be done on the lower guide section, whereby the fitter will enjoy better labour safety.

It is still further an object of the invention to disclose a system wherein the sliding element becomes automatically locked at the hinging point to be stationary as the sliding element is being turned open.

The system of the invention is characterized by that which has been stated in Claim 1.

As taught by the invention, the guide wheel sets on the underside are wheel sets carrying the sliding element on the lower guide section, the whole weight of the sliding element resting on the lower guide section. Furthermore, to the lower side is connected a vertical wheel set, comprising a vertical wheel having a diameter smaller than the transversal inside dimension of the lower guide section. The plane of rotation of the vertical wheel is vertical, i.e., coinciding with the plane of the sliding element. The peripheral cross section of the vertical wheel is advantageously round-shaped. The point of contact of the vertical wheel with the lower guide section lies on the same vertical with the central axis of the wheel axle. Furthermore, the lower guide section comprises a longitudinal, upward open bottom groove of which the edges serve as rolling surfaces for the vertical wheel. The vertical wheel and bottom groove are so matched and dimensioned in relation to each other that when the plane of rotation of the vertical wheel parallels the bottom groove, the vertical wheel extends partly into the bottom groove. Thereby, when the sliding element is turned at the hinging point to become positioned at an angle against the guide sections, the vertical wheel, disposed to be fixed relative to the sliding element, will turn to an identical angle relative to the longitudinal direction of the bottom groove and it will rise upward, carried by the edges of the bottom groove, whereby the first coupling member becomes form-locked with the second coupling member.

In an embodiment of the system, the periphery of the vertical wheel has a round-shaped cross section, such as one of circular or oval shape.

In an embodiment of the system, the edges of the bottom groove have a round-shaped cross section. The cross section of the bottom groove may certainly present many different shapes, e.g. so that the edges of the groove are straight bevels. Their bevel angle may also change at appropriate points.

In an embodiment of the system, the upper guide section comprises vertical, substantially planar inside walls, which serve as rolling surface for the horizontal wheel. The diameter of the horizontal wheel is smaller that the distance between the inside walls of the upper guide section, whereby the horizontal wheel fits with a given play into the upper guide section and rests against one or the other inner wall. The inner walls are vertical and planar so that the horizontal wheel can move vertically relative to the upper guide section.

In an embodiment of the system, the first coupling member is a pin disposed on the upper end of the wheel axle, and the second coupling member is a recess disposed to receive said pin in itself.

In an embodiment of the system, the upper guide section and the lower guide section are identical The horizontal wheel and vertical wheel are also advantageously identical. As a consequence, the number of different parts is small.

In an embodiment of the system the guide section presents a symmetrical cross section.

In an embodiment of the system the vertical wheel set comprises a body component in which the vertical wheel is rotatably carried.

In an embodiment of the system the body component is fixedly connected to the sliding element.

In an embodiment of the system the body component is rotatably carried to be swivellable relative to the sliding element; and the system comprises interlocking members for locking the body parts and the sliding element in fixed position relative to each other.

An advantage of the invention is that the system is inexpensive and the parts and the components thereto belonging are simple in construction, and a smaller number of components than heretofore is needed.

It is further an advantage of the invention that no accurate adjustments of the upper guide section need be done; the essential adjustments of the system, i.e., adjustment of the parallellism of the upper and lower guide sections, and of their distance from each other, can be done by adjusting the lower guide section, whereby the fitter's labour safety is improved.

It is moreover an advantage of the invention that the sliding element becomes automatically locked in position at the hinging point, in connection with swivelling the sliding element to opened position.

Figure 2:
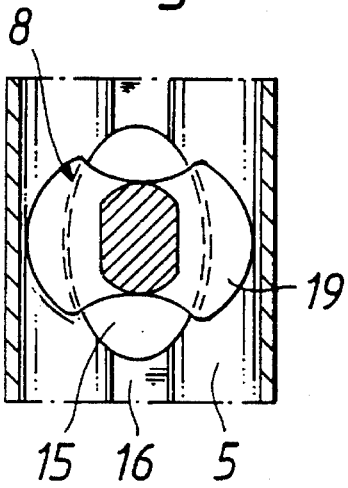
Figure 5:
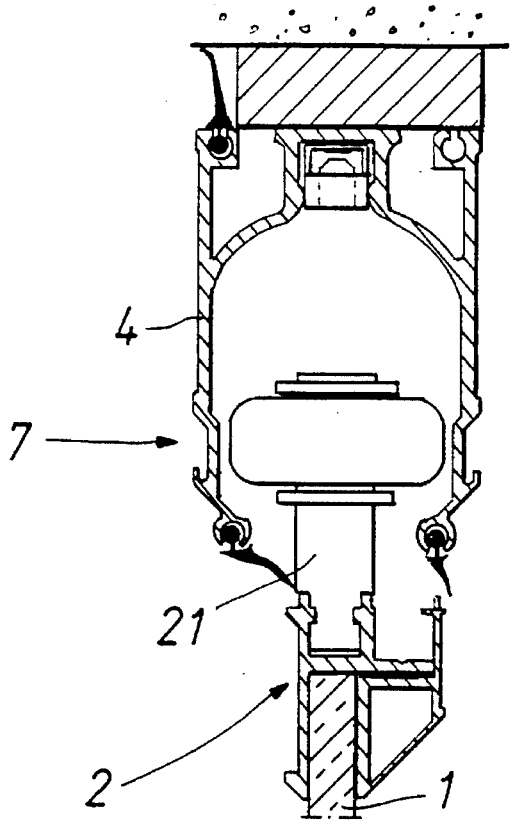
Figure 7:
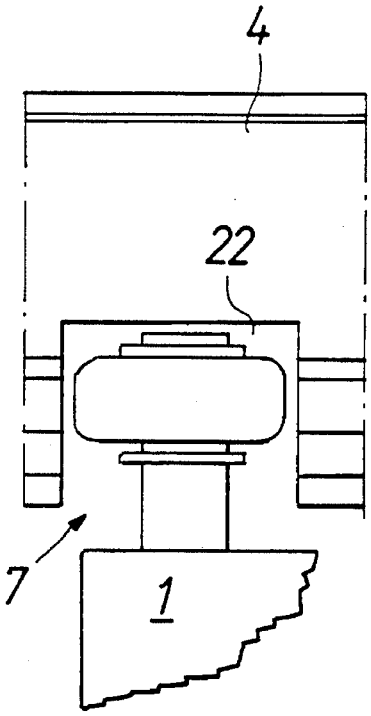
Figure 6:
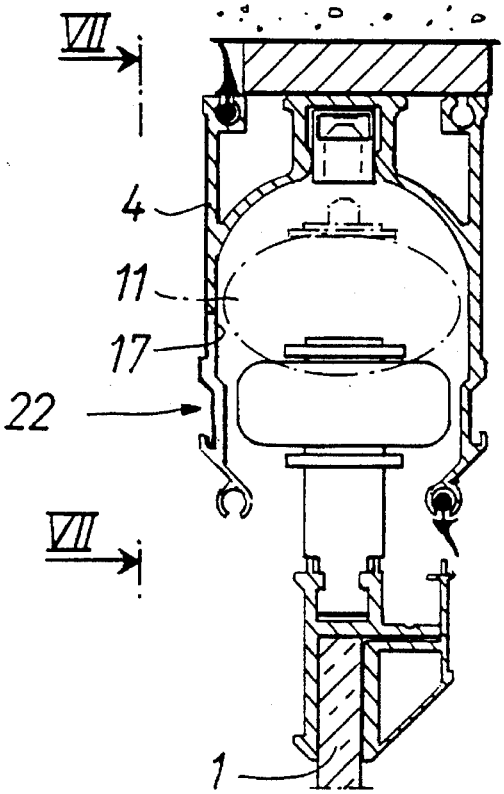
Figure 8:
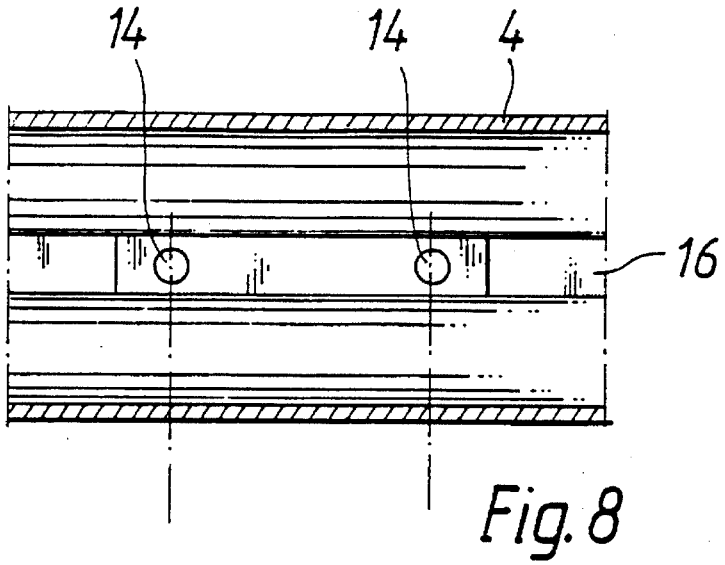
Figure 9:
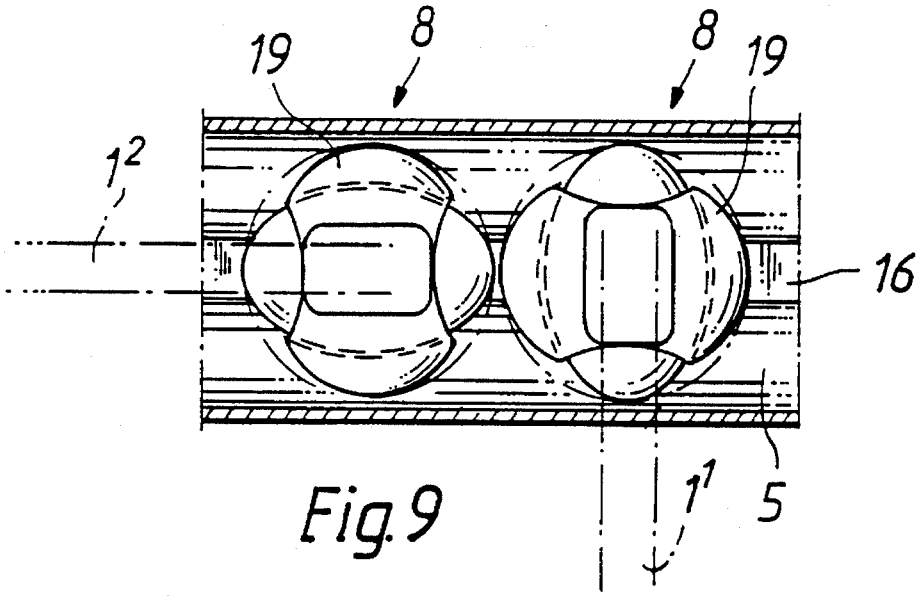
Figure 10:
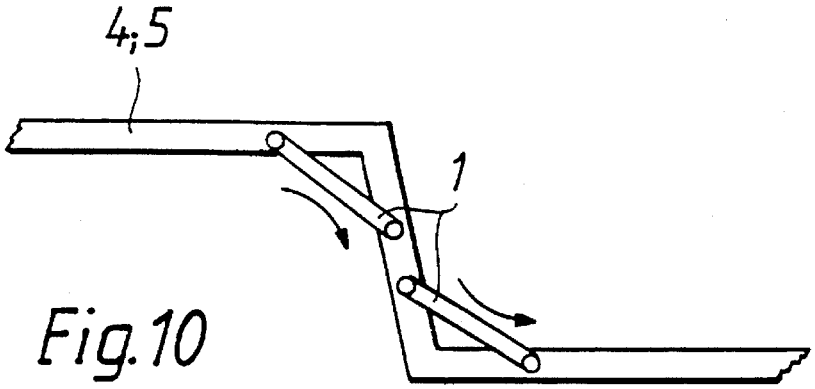
Figure 11:
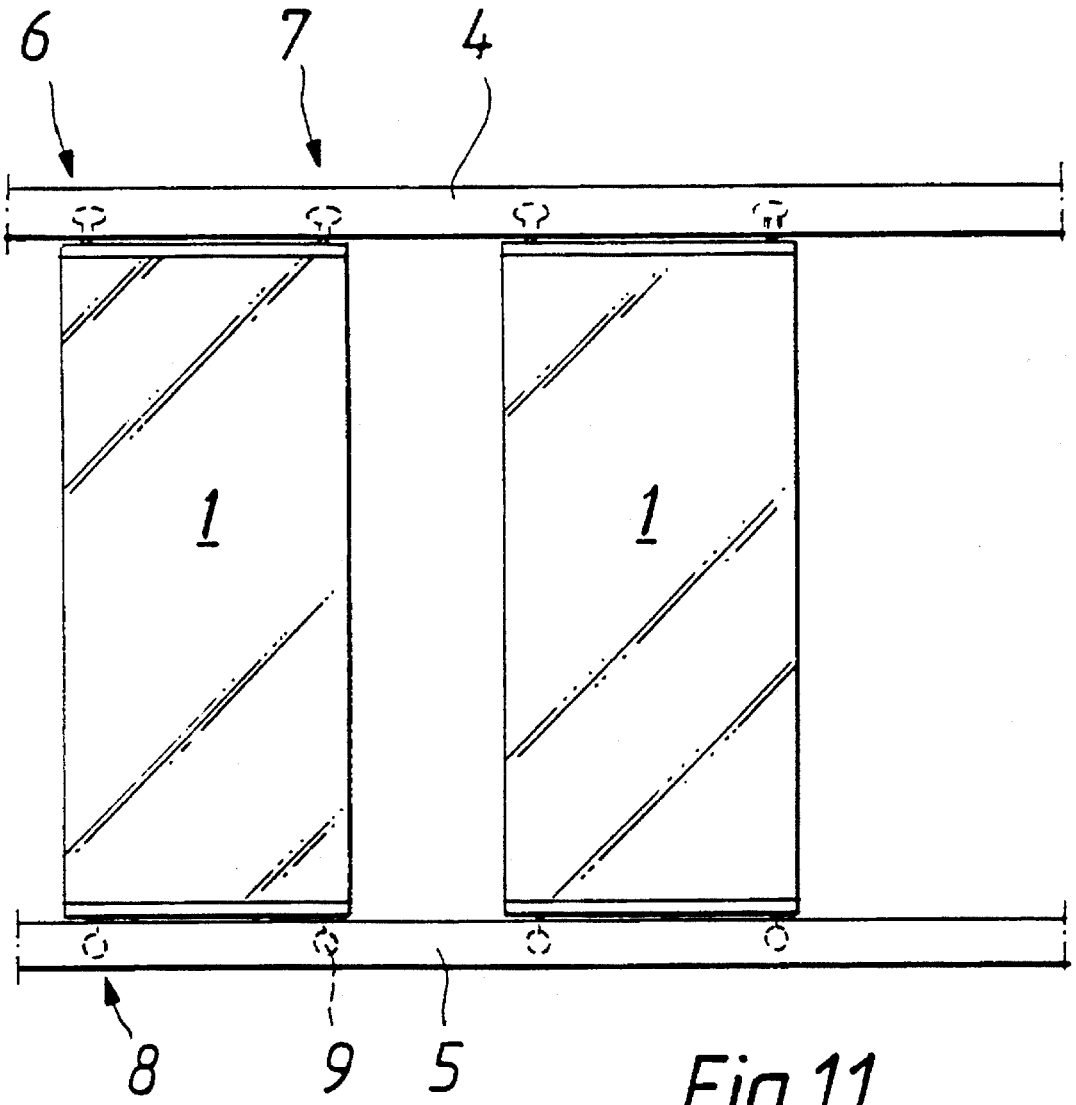

In the following the invention is described in detail, referring to the accompanying drawing, wherein FIG. 1 presents an embodiment of the system of the invention, as a cross section at right angles against the longitudinal direction of the guide sections, the plane of the sliding element parallelling the guide sections;

FIG. 2 presents the section II—II of FIG. 1;

FIG. 3 presents the embodiment of FIG. 1, sliding element being opened to an angle against the guide sections and locked to be stationary at its hinging point;

FIG. 4 presents the section IV—IV of FIG. 3;

FIG. 5 presents the upper guide section of the embodiment of FIG. 1 and the guide wheel set on the opening side, attached to the upper side of the sliding element, at a point of the guide section;

FIG. 6 presents the opening-side guide wheel sets of FIG. 1 at a point of the guide section, where an aperture has been provided for the opening-side guide wheel sets to pass through;

FIG. 7 presents a detail of FIG. 6, as viewed from the direction VII—VII of FIG. 6;

FIG. 8 presents the section VIII—VIII of the upper section from FIG. 1;

FIG. 9 presents the section of the lower section at the point corresponding to that in FIG. 8, the vertical wheel on the right side having been turned into open position and the adjacent vertical wheel having been brought next to it, to be turned into open position;

Fig. 10 presents, in top view and schematically, a guide section provided with corners, and two sliding elements passing past the corners; and FIG. 11 presents schematically part of the sliding element system, showing two sliding elements in guidance by guide sections, as viewed at right angles against the guide sections.

In FIG. 1 is depicted, in cross section, a sliding element system wherein the sliding elements 1 are vertical balcony glass elements. The system comprises a rectangular sliding element 1 having an upper side 2 and a lower side 3, parallelling each other. In FIG. 1 is shown only that part of the sliding element which is located in the vicinity of the guide sections. The system further comprises an elongated and box-like upper guide section 4, which is the guide rail on the upper side. The elongated and box-like lower guide section 5 is on the lower side, relative to the sliding element 1. As can be seen in FIGS. 1 and 3, the upper and lower guide sections are similar in shape and symmetrical with reference to their vertical axis. They are made e.g. of aluminium in the usual way by an extrusion process.

As can also be seen in FIG. 11, there are guide wheel sets 6, 7, 8, 9 connected to the upper side 2 and lower side 3 of the sliding element, which in cooperation with the guide sections 4 and 5 guide the sliding element 1 when it is being moved in the direction of the guide sections 4 and 5.

Referring again to FIG. 1, the figure shows the upper side horizontal wheel set 6, which is connected to the upper side 2 of the sliding element 1. The horizontal wheel set comprises a vertical axle 10, affixed to the upper side 2, and a horizontal wheel 11, rotatably carried on the wheel axle 10. The plane of rotation of the horizontal wheel 11 is horizontal. The guide wheel sets run, guided by the guide sections, well-protected by their box-like encasement therewithin. The vertical planar inner walls 17, 18 of the upper guide section 4 serve as rolling surface for the horizontal wheel 11.

The guide wheel sets 8, 9 on the lower side 3 of the sliding element, of which only the guide wheel sets 8 can be seen in the figure, furnish support of the sliding element 1 on the lower guide section 5, and it is thus understood that the whole weight of the sliding element 1 rests on the lower guide section 5.

To the lower side 3 is connected a vertical wheel set 8, comprising a vertical wheel 15. The diameter of the vertical wheel 15 is smaller than the distance between the inner walls 24, 25 of the lower guide sections.

The plane of rotation of the vertical wheel 15 is vertical, and its point of contact with the lower guide section 5 lies on the same vertical line with the central axis of the vertical wheel axle 10.

The lower guide section 5 comprises an elongated, upward open bottom groove 16, its edges serving as rolling surfaces for the vertical wheel 15. The vertical wheel 15 and the bottom groove 16 have been so fitted together and dimensioned that when the vertical wheel 15 is in such position that its plane of rotation parallels the bottom groove 16, the vertical wheel extends partly into the bottom groove 16, whereby when the sliding element is swivelled at a hinging point into angular position relative to the guide sections 4, 5, the vertical wheel 15 which has been disposed fixedly relative to the sliding element 1 will turn to form the same angle with the longitudinal direction of the bottom groove 16 and will rise upward, borne by the edges of the bottom groove 16. The edges of the bottom groove 16 present a round-shaped cross section.

On the side of the upper guide section 4 a hinge arrangement has been provided in the system, comprising the following interlocking components: a first coupling member 13, which is a pin connected to the wheel axle 10, and a second coupling member 14, which is a recess and connected to the upper guide section 4. The recess 14 is disposed to receive the pin 13 in itself. The wheel axle 10 serves, after the pin 13 and the recess 14 have been coupled together, as a hinge axis about which the sliding element 1 can be swivelled.

FIGS. 1 and 2 reveal that the vertical wheel 15 has oval shape, and this facilitates its turning and ascent into the position shown in FIG. 3, in which the sliding element 1 has been swivelled at the hinging point to be at right angles against the guide sections 4, 5. The vertical wheel 15 has now turned to be at right angles against the longitudinal direction of the bottom groove 16, and it has risen upward, carried by the edges of the bottom groove 16 as illustrated also by the sectional view in FIG. 4. In corresponding manner, the pin 13 has entered the recess 14, and the sliding element is held firmly in place. The vertical wheel 15 fits transversally into the lower guide section 5 with free play.

As can further be seen in FIGS. 1–4, the vertical wheel set 8 comprises a body part 19 in which the vertical wheel 15 is rotatably carried. The body part 19 has in the embodiment of FIGS. 1 and 3 been fixedly attached to the sliding element 1. It is equally possible to arrange the body part 19 to be carried rotatably relative to the sliding element 1. In that case, the system comprises interlocking members (not depicted in the figures) by which the body part 19 and the sliding element 1 are locked in a fixed position relative to each other for swivelling at the hinging point.

FIG. 5 shows a cross section of the upper guide section 4 at a point where is found a second guide wheel set 7, attached to the upper side 2 of the sliding element 1 and which also is a horizontal wheel set, as on the hinge side (FIGS. 1, 3), yet with the difference that the vertical wheel axle 21 is shorter than on the hinge side. The significance hereof is revealed by FIGS. 6 and 7, showing an aperture 22 through which the horizontal wheel set 8 on the opening side can emerge, while the horizontal wheel 11 on the hinge side can pass without exiting trough the aperture 22, because the horizontal wheel 11 (schematically indicated with dot-and-dash lines) rests against the inside wall 17 at a point above the aperture 22.

In FIG. 8 is depicted, sectioned and by way of example, a hinge block 23 affixed to the bottom groove of the upper guide section 4, as can be seen in FIGS. 1 and 3 as well. The hinge block 23 presents two second coupling members 14, i.e., two recesses 14 spaced from each other. To such a hinge block 23 two sliding elements 1 can be secured side by side. It is obvious that hinge blocks can be formed which have a greater or smaller number of recesses. It is also possible to place any desired number of such blocks one after the other.

FIG. 9 presents a section of a lower guide section 5, in which two vertical wheel sets 8 have been conveyed to be side by side. They belong to different sliding elements $1^1$ and $1^2$, which have been schematically indicated with dot-and-dash lines. The right-hand vertical wheel set belongs to sliding element $1^1$, which has been swivelled at the hinging point to be open, i.e., at right angles against the guide section. The vertical wheel set on the left belongs to sliding element $1^2$, which is still parallel to the guide section but has been brought next to the right-hand sliding element $1^1$, in readiness to be similarly turned. In order that the sliding elements $1^1$, $1^2$ might position themselves at the proper hinging point, relative to each other, that is in order that the pin 13 on the wheel axle might register with closest accuracy with the recess 14 (FIGS. 1 and 3) when one begins to turn the sliding element $1^2$, the body part 19 of the vertical wheel set 8 has been given such shape that when the vertical wheel 15 of the adjacent sliding element meets the body part 19 the pin 13 is in register with the recess. In order that they might stay in the right position during swivelling, the body part 19 has been given round-formed shape and it has been so dimensioned that the extreme dimension of the body part 19 in the direction at right angles against the plane of rotation of the vertical wheel 15 substantially equals the diameter of the vertical wheel 15.

Advantageously, to the upper side 2 of the sliding element 1 have been connected two horizontal wheel sets 6 and 7 at a distance from each other, and to the lower side 3 have been connected two vertical wheel sets 8 and 9 at a distance from each other, as in FIG. 11.

In FIG. 10 is illustrated, viewed from above and schematically, an application implemented with a system according to FIGS. 1–7 wherein the sliding elements can be slid past sharp angles made in the guide section. In this instance, advantageously, the vertical wheel set has been arranged to be turnable, as described in the foregoing. However, it is possible even with a fixed vertical wheel set to convey the sliding element trough comparatively gentle angulations, thanks to the favourable shaping of vertical wheel and of the guide section.

It should be noted that the sliding element system of the invention is usable in a great variety of applications. The sliding elements may be windows, doors, partitions, etc. movable on guide sections. For instance, the system is usable as a balcony glazing system in which the sliding elements are glass elements.

The invention is not exclusively delimited to concern the embodiment examples presented in the foregoing: numerous modifications are feasible within the scope of the inventive idea defined in the claims.

I claim:

1. A sliding element system, comprising a substantially vertical sliding element (1) having an upper side (2) and a lower side (3), parallelling each other; an elongated and box-like upper guide section (4), located adjacent to the upper side; an elongated and box-like lower guide section (5) located adjacent to the lower side; guide wheel sets (6, 7, 8, 9), which are connected to the upper side and the lower side of said sliding element and comprising at least one horizontal wheel set (6), comprising a vertical wheel axle (10), which is attached to the upper side (2), and a horizontal wheel (11), rotatably carried on a wheel shaft so that its plane of rotation is horizontal, and the guide wheel sets are disposed to run in guidance of the guide sections and within them; and a hinge arrangement (12), comprising interlocking members: a first coupling member (13), connected to the wheel axle (10); and a second coupling member (14), connected to the upper guide section (4); and wherein the wheel axle (10), upon engagement of the coupling members serves as a hinge axis about which the sliding element can be swivelled; wherein the guide wheel sets (8, 9) on the lower side (3) support the sliding element (1) on the lower guide section (5); to the lower side (3) is connected a vertical wheel set (8), comprising a vertical wheel (15), the diameter of which is smaller than the transverse inside dimension of the lower guide section and the plane of rotation of which is located on the same vertical plane with the central axis of the vertical wheel axle (10); the lower guide section (5) comprises a longitudinal, upward open bottom groove (16), the edges of which serve as rolling surfaces for the vertical wheel (15); and the vertical wheel (15) and the bottom groove (16) are so fitted together that when the plane of rotation of the vertical wheel parallels the bottom groove, the vertical wheel extends partly into the bottom groove, whereby when the sliding element is swivelled at a hinging point to form an angle with the guide sections, and the vertical wheel (15) which is fixedly disposed in relation to the sliding element will turn to the same angle against the longitudinal direction of the bottom groove and will rise upwardly carried by the edges of the bottom groove (16), whereby the first coupling member (13) will be coupled in form-locked connection with the second coupling member (14).

2. System according to claim 1, characterized in that the periphery of the vertical wheel (15) has a round-shaped cross section, such as a circular or oval cross section.

3. System according to claim 2, characterized in that the edges of the bottom groove (16) have a round-shaped cross section.

4. System according to claim 1, characterized in that the edges of the bottom groove (16) have a round-shaped cross section.

5. System according to claim 1, characterized in that the upper guide section (4) comprises vertical, substantially planar inside walls (17, 18), which serve as rolling surface for said horizontal wheel (11).

6. System according to claim 5, characterized in that the upper guide section (4) and the lower guide section (5) are identical.

7. System according to claim 5, characterized in that the guide section (4, 5) is symmetrical in its cross section.

8. System according to claims 1, characterized in that the first coupling member (13) is a pin disposed on the top end of the vertical wheel axle (10), and the second coupling member (14) is a recess disposed to receive said pin in itself.

9. System according to claim 1, characterized in that the upper guide section (4) and the lower guide section (5) are identical.

10. System according to claim 9, characterized in that the guide section (4, 5) is symmetrical in its cross section.

11. System according to claims 1, characterized in that the guide section (4, 5) is symmetrical in its cross section.

12. System according to claims 1, characterized in that the vertical wheel (8) comprises a body part (19) in which the vertical wheel (15) is rotatably carried.

13. System according to claim 12, characterized in that the body part (19) is fixedly connected with the sliding element.

* * * * *